US007287663B2

(12) United States Patent
Vandal et al.

(10) Patent No.: US 7,287,663 B2
(45) Date of Patent: Oct. 30, 2007

(54) LINED PRESSURE VESSEL AND CONNECTOR THEREFOR

(75) Inventors: Peter J. Vandal, Pawtucket, RI (US); Bruce Murdock, Coventry, RI (US); Christopher A. VanHaaren, Warwick, RI (US)

(73) Assignee: Amtrol Inc., West Warwick, RI (US)

( * ) Notice: Subject to any disclaimer, the term of this patent is extended or adjusted under 35 U.S.C. 154(b) by 393 days.

(21) Appl. No.: 11/029,441

(22) Filed: Jan. 5, 2005

(65) Prior Publication Data

US 2006/0144843 A1 Jul. 6, 2006

(51) Int. Cl.
*F17C 1/02* (2006.01)

(52) U.S. Cl. ..... 220/586; 220/4.12; 220/4.13; 220/589; 220/590

(58) Field of Classification Search ..... 220/586, 220/4.12, 4.13, 589, 590
See application file for complete search history.

(56) References Cited

U.S. PATENT DOCUMENTS 2,473,669 A * 6/1949 White ..... 220/567.3
2,970,719 A * 2/1961 Brady, Jr. ..... 220/678
3,268,103 A * 8/1966 Nelson ..... 220/586
3,357,594 A * 12/1967 Grosh et al. ..... 220/683
3,358,118 A * 12/1967 Mather et al. ..... 392/458
3,508,677 A * 4/1970 Laibson et al. ..... 220/590
4,241,843 A * 12/1980 Walker et al. ..... 220/4.12
4,360,116 A * 11/1982 Humphrey ..... 220/586
4,491,247 A * 1/1985 Nitchman et al. ..... 222/131
4,690,295 A * 9/1987 Wills ..... 220/590
4,699,294 A * 10/1987 Carlin, Jr. ..... 220/319
4,968,066 A * 11/1990 Adams ..... 285/142.1
5,046,638 A * 9/1991 Wolf ..... 220/679
5,135,133 A * 8/1992 Frost ..... 220/601
5,217,140 A * 6/1993 Lindahl ..... 220/4.06
5,287,987 A * 2/1994 Gaiser ..... 220/589
5,345,666 A * 9/1994 Matyja ..... 29/451
5,386,925 A * 2/1995 Lane ..... 220/530
5,568,878 A * 10/1996 LeBreton ..... 220/62.19
6,510,959 B1 * 1/2003 Van Newenhizen ..... 220/4.12

OTHER PUBLICATIONS

Boiler Mate Classic Series—Indirect-Fired Water Heaters with Small Control, Installation, Operation & Maintenance Insructions, AMTROL Inc., Apr. 2002.
Boiler Mate, Indirect-Fired Water Heaters, AMTROL Inc. (brochure), Apr. 1, 2004.

* cited by examiner

*Primary Examiner*—Anthony Stashick
*Assistant Examiner*—Christopher McKinley
(74) *Attorney, Agent, or Firm*—Edwards Angell Palmer & Dodge LLP; Scott D. Wofsy

(57) ABSTRACT

A pressure vessel is disclosed which includes a lower metallic dome having a lower rim portion, and an upper metallic dome having an upper rim portion, a plastic liner disposed within the upper and lower metallic domes, a metallic band disposed between the plastic liner and the upper and lower metallic domes proximate the respective rim portions thereof, and an insulating material disposed between the metallic band and the plastic liner, the metallic band and insulating material protecting the plastic liner from elevated temperatures when the upper and lower rim portions of the metallic domes are welded together. A method of fabricating the pressure vessel and a connector for assembling the pressure vessel are also disclosed.

23 Claims, 3 Drawing Sheets

FIG. 3
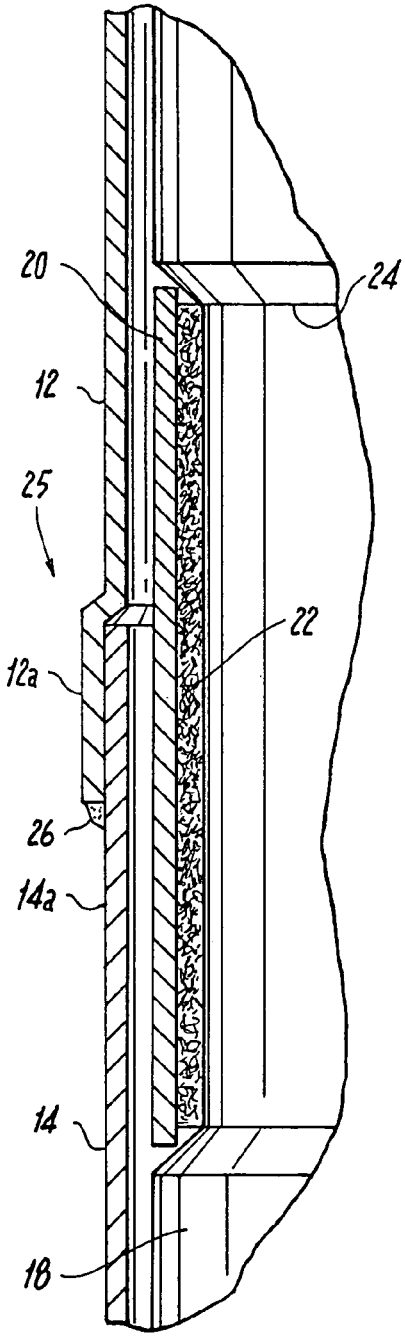
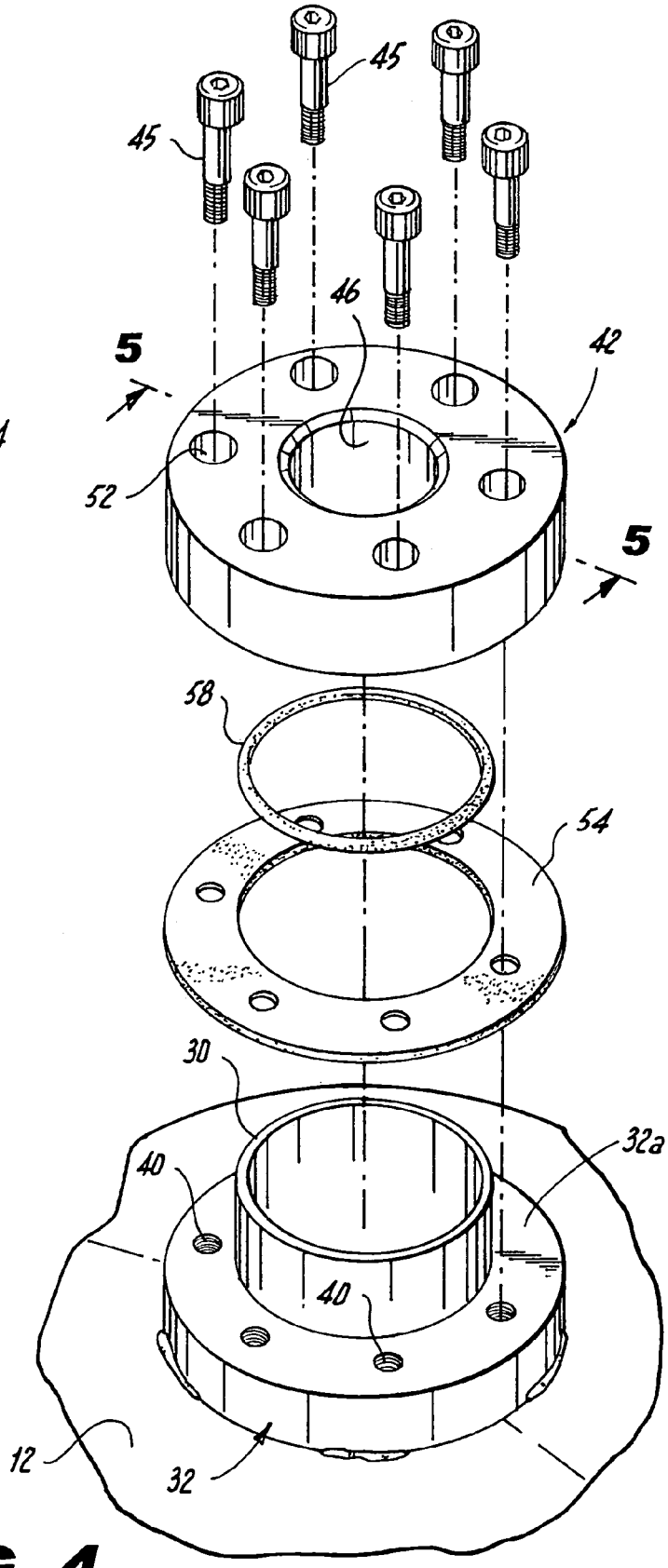
FIG. 4

LINED PRESSURE VESSEL AND CONNECTOR THEREFOR

BACKGROUND OF THE INVENTION

1. Field of the Invention

The subject invention relates to pressure vessels for fluid storage, and more particularly to a metallic tank having a molded plastic liner, a thermal barrier for protecting the plastic liner during assembly of the vessel, and a connector for joining the metallic tank and plastic liner together.

2. Background of the Related Art

Pressure vessels that combine the strength of an exterior metallic tank and the passivity of an interior plastic liner are well known in the art. Such tanks have achieved widespread usage in the field of domestic fluid storage, including hot water storage tanks, hot water heating tanks and accumulators for hot water heating systems.

Because of the enclosed nature of these pressure vessels, they are more easily fabricated in several sections, which are subsequently welded together. However, great care must be taken when welding the tank sections together, to avoid damaging the interior plastic lining. Any damage or discontinuity in the lining could result in the eventual contamination of the contents of the tank and corrosion of the exterior metal components.

Several attempts have been made to overcome this problem. One solution has been to apply a liner coating to the metal tank after it has been welded together, as exemplified in U.S. Pat. No. 2,758,367. However, this limits the types of coatings that may be applied to the interior of a closed vessel. The process is also time consuming and expensive, and there is no assurance that the lining will completely cover the interior of the vessel as intended.

Another method of fabricating lined, multi-piece metallic vessels involves the use of a chill ring placed in the interior of the metallic vessel adjacent the weld area. The chill ring is usually an annular metal structure, which may or may not have a coating thereon. It serves to absorb the heat generated by the welding process such that it does not destroy the tank lining. The use of chill rings is disclosed in U.S. Pat. Nos. 2,412,271 and 2,970,719.

It is also known to utilize a rubber material as an insulating band installed adjacent to a welding area, as set forth in U.S. Pat. No. 2,587,840. However, the purpose of this insulating band is not to protect the lining of the tank, but to prevent the current generated by the electric welding process from jumping to an adjacent metallic wall.

Commonly assigned U.S. Pat. No. 4,241,843 discloses unique features to enable the welding of two metal tank sections together without causing damage to an interior plastic liner. In this instance two vertically divided foam insulation halves surround the interior plastic liner to form a heat shield around the liner and prevent damage thereto during the welding process.

U.S. Pat. No. 5,046,638 discloses a pressure vessel having an interior plastic liner, wherein a sacrificial fluoropolymer layer of material is provided adjacent the weld area, between the liner and the metallic tank, to protect the liner layer from the heat of weld formation.

Another problem associated with manufacturing a pressure vessel with an external metallic tank and a non-corrosive internal plastic liner is providing a cost efficient means for connecting the two structures together to form an integral vessel. The prior art is replete with connectors for this purpose. However, many are susceptible to leakage. Leakage at the connector can cause corrosion of the metallic components of the pressure vessel and can damage system components carrying fluid to and from the pressure vessel.

Clearly, there is a need in the art for a pressure vessel having an external metallic tank and in internal plastic liner that includes a insulated barrier for protecting the plastic liner from thermal damage during vessel assembly, and a leak-proof connector for joining the metallic tank and plastic liner together to form an integral vessel.

SUMMARY OF THE INVENTION

The subject invention is directed to a unique pressure vessel, which combines the strength of a metallic tank with the interior passivity of a plastic tank. The pressure vessel comprises a lower metallic dome having a lower rim portion, an upper metallic dome having an upper rim portion, and a plastic liner disposed within the upper and lower metallic domes. A metallic band is disposed between the plastic liner and the upper and lower metallic domes proximate the respective rim portions thereof, and an insulating material is disposed between the metallic band and the plastic liner. The metallic band and insulating material protect the plastic liner from elevated temperatures that are presented when the upper and lower rim portions of the metallic domes are welded together.

Preferably, the plastic liner is molded and has a circumferential recess about its horizontal midline for accommodating the insulating material and the metallic band. The upper rim portion of the upper metallic dome preferably forms a circumferential flange that surrounds the lower rim portion of the lower metallic dome to form weld joint.

The upper metallic dome includes a central orifice and the plastic liner includes a cylindrical neck portion that extends through the central orifice in the upper metallic dome. An annular mounting flange is welded or otherwise secured to the upper metallic dome and is dimensioned and configured to surround the cylindrical neck portion of the plastic liner. The annular mounting flange has an upper planar surface, and circumferentially spaced bolt holes are formed in the upper planar surface.

An annular connector flange is also provided. The connector flange has a radially inner annular portion that defines a central bore for communicating with the central orifice in the upper metallic dome and a radially outer annular portion configured for fastening to the annular mounting flange. An annular groove is formed between the radially inner and radially outer annular portions of the connector flange for accommodating the cylindrical neck portion of the plastic liner.

The radially outer annular portion of the connector flange has a lower planar surface and circumferentially spaced apart bolt holes are formed therein which correspond to the circumferentially spaced apart bolt holes formed in the upper planar surface of the annular mounting flange. Bolts extend through these holes to securely fasten the connector flange to the mounting flange. Preferably, a planar sealing gasket is disposed between the upper planar surface of the mounting flange and the lower planar surface of the radially outer annular portion of the connector flange. In addition, a radially inner edge of the radially outer annular portion of the connector flange is preferably truncated to form a sealing surface to accommodate an O-ring seal positioned about the periphery of the cylindrical neck portion of the plastic liner. This seal prevents liquid inside the plastic liner from contacting the metallic components of the pressure vessel.

The subject invention is also directed to a pressure vessel that comprises a lower metallic dome having a lower rim portion, an upper metallic dome having a central orifice formed therein and an upper rim portion secured to the lower rim portion of the lower metallic dome. A molded plastic liner is disposed within the upper and lower metallic domes and it includes a cylindrical neck portion that is dimensioned and configured to extend through the central orifice of the upper metallic dome. A mounting flange is secured to the upper metallic dome and it surrounds the cylindrical neck portion of the plastic liner.

The pressure vessel further includes an annular connector flange having a radially inner annular portion that defines a central bore for communicating with the central orifice of the upper metallic dome, a radially outer annular portion for fastening to the annular mounting flange, and an annular groove that is formed between the radially inner and radially outer annular portions of the connector flange for receiving or otherwise accommodating the cylindrical neck portion of the plastic liner.

The subject invention is also directed to a method of fabricating a pressure vessel which includes the steps of providing a molded plastic tank liner, circumscribing the horizontal midline of the plastic tank liner with a layer of insulation, and surrounding the layer of insulation with a metallic band. The method further includes the steps of enclosing the plastic tank liner within upper and lower metallic domes, forming a joint between the upper and lower domes proximate the metallic band, and then welding the domes to one another at the joint. Preferably, the step of forming a joint between the domes involves forming a lap joint between an upper rim portion of the upper metallic dome and a lower rim portion of the lower metallic dome, which is subsequently welded.

These and other aspects of the pressure vessel of the subject invention and the unique connector flange therefor will become more readily apparent to those having ordinary skill in the art from the following detailed description of the invention taken in conjunction with the drawings.

BRIEF DESCRIPTION OF THE DRAWINGS

So that those having ordinary skill in the art to which the present invention pertains will more readily understand how to make and use the lined pressure vessel of the present invention, embodiments thereof will be described in detail hereinbelow with reference to the drawings, wherein:

FIG. 3 is a cross-sectional view taken along line 3-3 of FIG. 1 illustrating the composite joint between the upper and lower domes of the pressure vessel of FIG. 1;

FIG. 4 is an exploded perspective view of the connector flange for joining the upper dome of the pressure vessel and the molded plastic liner;

DETAILED DESCRIPTION OF PREFERRED EMBODIMENTS

Figure 1:
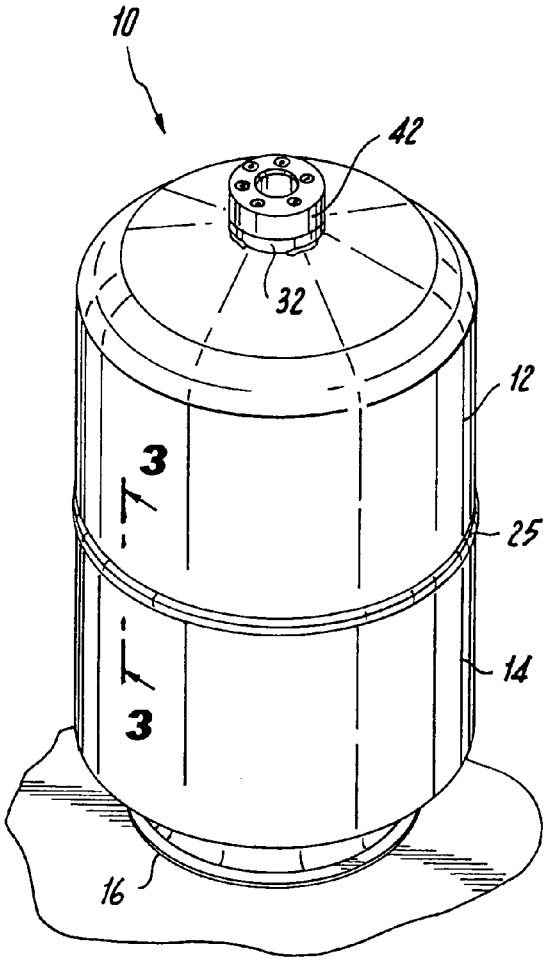
FIG. 1 is a perspective view of a pressure vessel constructed in accordance with a preferred embodiment of the subject invention.

Referring now to the drawings wherein like reference numerals identify similar aspects and/or features of the subject invention there is illustrated in FIG. 1 a pressure vessel configured in accordance with a preferred embodiment of the subject invention and designated generally by reference numeral 10.

Figure 2:
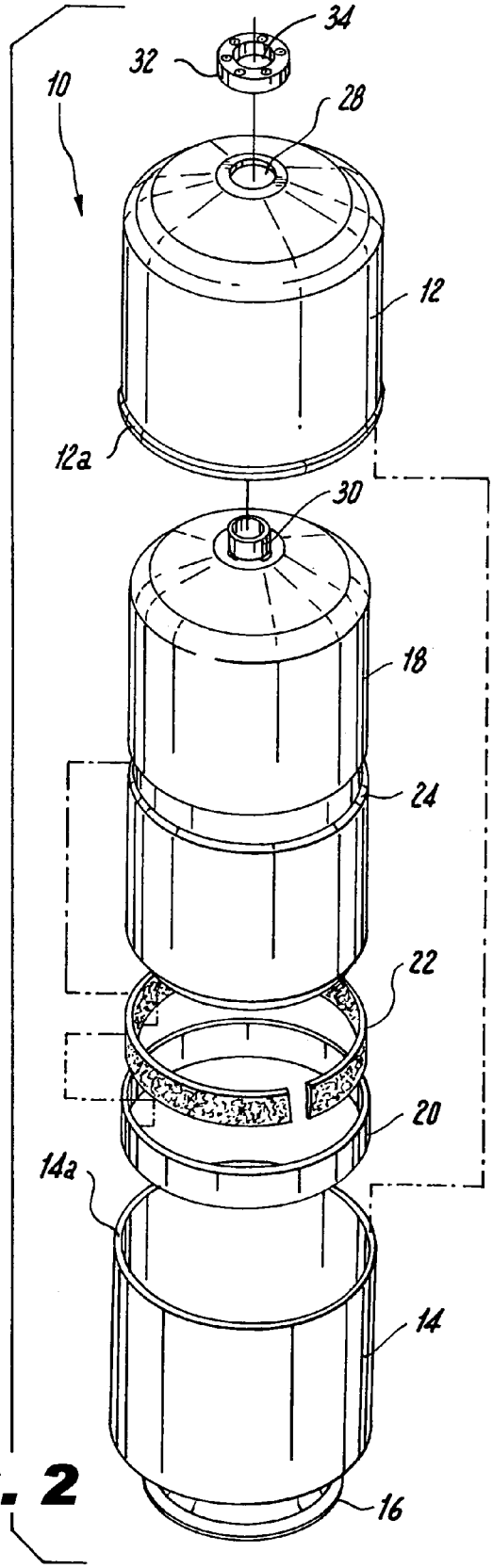
FIG. 2 is an exploded perspective view of the pressure vessel shown in FIG. 1 with parts separated for ease of illustration.

Referring to FIGS. 1 and 2, pressure vessel 10 includes an upper metallic dome 12 having an upper rim portion 12*a*, a lower metallic dome 14 having a lower rim portion 14*a*. The upper and lower metallic domes 12, 14 are preferably formed from high strength structural steel or a similar material. The lower metallic dome 14 includes a cylindrical base or platform 16 for supporting the pressure vessel 10 on a surface. A molded plastic liner 18 is disposed within the upper and lower metallic domes 12, 14. The plastic liner 18 acts as a barrier between the external steel domes 12, 14 and the internal fluid. Consequently, pressure vessel 10 combines the strength of an external metallic tank with the interior passivity of a plastic tank. The plastic liner 18 may be made of any rigid or semi-rigid plastic material depending on the type of liquids with which the tank is used.

A metallic band 20 is disposed between the plastic liner 18 and the upper and lower metallic domes 12, 14, proximate the respective rim portions 12*a*, 14*a* thereof. Metallic band 20 is preferably formed from steel or a similar metal, and has a preferred thickness of about 0.0234" (24-gage). However, the thickness of the band can vary from one vessel to another depending upon specific design criteria. In addition, at least one layer of insulating material 22 is disposed between the metallic band 20 and the molded plastic liner 18. The insulating material 22 is preferably a fiber material that is not thermally consumable under the heat produced by welding, which is generally about 1500° F. It is envisioned that the insulating material can be a material other than a fibrous insulating material. For example, foam based insulating materials or gel based insulating materials can be utilized.

The metallic band 20 and the insulating material 22 circumscribe the liner 18 and function as a thermal barrier to protect the liner 18 from the elevated temperatures that are presented when the upper and lower rim portions 12*a*, 14*a* of the upper and lower metallic domes 12, 14 are welded together to form an integral pressure vessel. More particularly, the metal band serves as a heat sink to disperse heat from the weld zone. In essence, the steel band 20 decreases the heat experienced by the insulating material, so that it will not reach its consumable temperature.

Referring to FIG. 3, the plastic liner 18 has a circumferential recess 24 that extends about the horizontal midline of the liner 18 with a suitable depth to accommodate the insulating material 22 and the metallic band 20. The upper rim portion 12*a* of the upper metallic dome 12 preferably forms a radially outwardly stepped circumferential flange that surrounds or otherwise overlaps the lower rim portion 14*a* of the lower metallic dome 14 to form weld joint 25. More particularly, weld joint 25 is a lap joint formed by the free edges of the upper rim portion 12*a* and lower rim portion 14*a* that are welded together in a conventional manner by a fillet weld 26 or the like.

To fabricate pressure vessel 10, the circumferential recess 24 located about the horizontal midline of the plastic tank liner 18 is circumscribed with a layer of insulation 22. The insulation 22 is then surrounded by metallic band 20. The plastic tank liner 18 is then enclosed within the upper and lower metallic domes 12, 14, forming a lap joint 25 therebetween proximate the metallic band 20. Thereafter, the domes 12, 14 are welded to one another at the joint 25.

Figure 5:
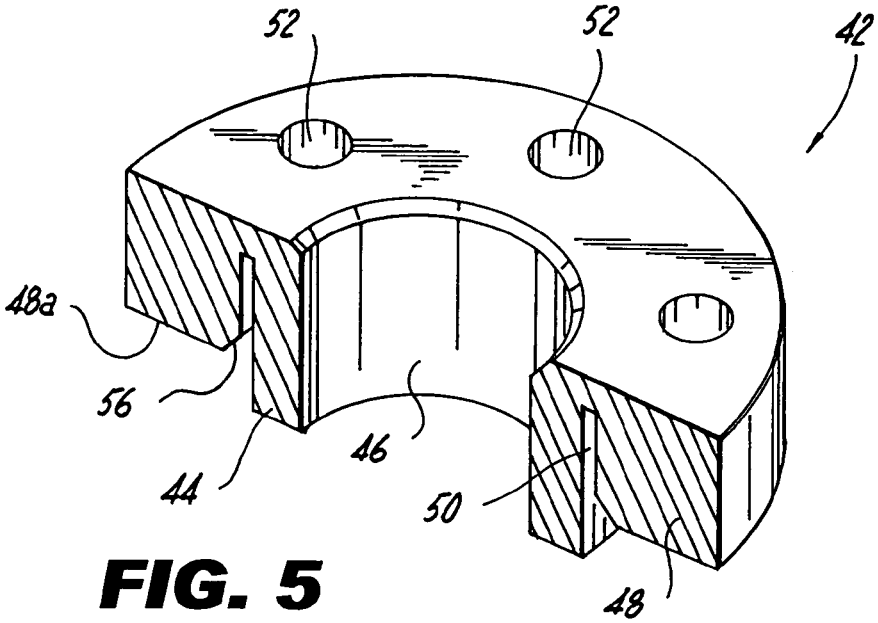
FIG. 5 is a cross-section view taken along line 5-5 of FIG. 4, illustrating the structural features of the connector flange.
Figure 6:
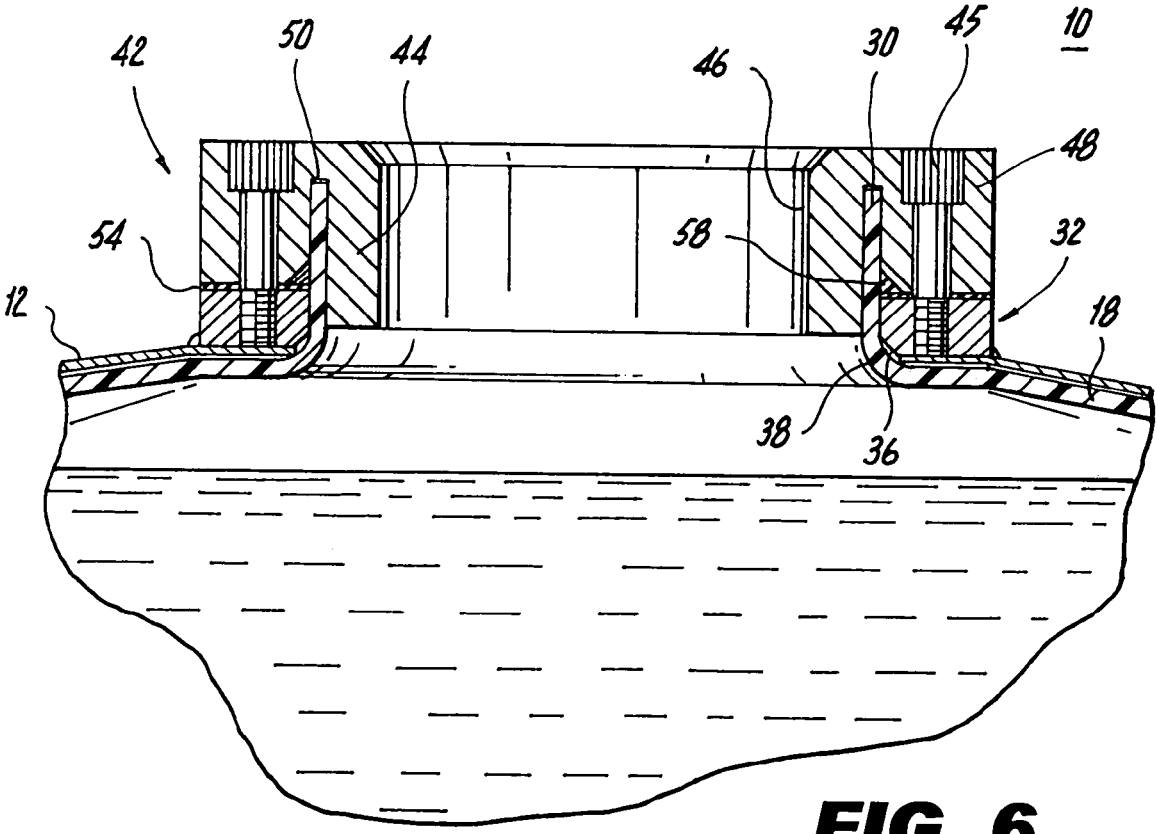
FIG. 6 is a side elevational view, in partial cross-section, of the upper portion of the pressure vessel of FIG. 1, illustrating the way in which the connector flange functions to connect the upper dome of the pressure vessel to the molded plastic liner to prohibit leakage.

Referring to FIGS. 4 through 6, there is illustrated a unique system for connecting the external metallic tank 12, 14 and the interior plastic liner 18 to one another to form the integral pressure vessel 10. More particularly, the upper metallic dome 12 of pressure vessel 10 includes a central orifice 28 and the inner plastic liner 18 includes a cylindrical neck portion 30 that extends through the central orifice 28 in the upper metallic dome 12. The neck portion 30 has a controlled outer diameter, inner diameter and height.

An annular mounting flange 32 formed from steel or a similar metal is welded or otherwise secured to the exterior surface of the upper metallic dome 12. Mounting flange 32 has a central bore 34 with an inner diameter that is substantially congruent with the outer diameter of the cylindrical neck portion 30 of the plastic liner 18 so as to achieve a close fit therebetween. As best seen in FIG. 6, the lower edge of the inner diameter of mounting flange 32 has a fillet 36 formed thereon to accommodate the curved transition region 38 formed between the plastic liner 18 and the neck portion 30 of the liner 18.

The annular mounting flange 32 has a substantially planar upper sealing surface 32*a*. Circumferentially spaced bolt holes 40 are formed in the upper surface 32*a*, which extend substantially through the mounting flange 32. These bolt holes 40 are preferably threaded.

The pressure vessel 10 of the subject invention further includes an annular connector flange 42, the structure of which is best illustrated in FIG. 5. Connector flange 42 has a radially inner annular portion 44 that defines a central bore 46 for communicating with the central orifice 28 in the upper metallic dome 12. Those skilled in the art will readily appreciate that the central bore 46 of connector flange 42 is easily adaptable to communicate with system connections (not shown) that carry fluid to and from pressure vessel 10. For example, the central bore 46 of connector flange 42 may be threaded in order to cooperate with a threaded system connection.

The outer diameter of the radially inner annular portion 44 is substantially congruent with the inner diameter of the neck portion 30 of plastic liner 18 so as to achieve a close fit therebetween, and preferably an interference fit is achieved. Connector flange 42 further includes a radially outer annular portion 48 that is shallower than the radially inner portion 44 of connector flange 42. That is the radially inner annular portion 44 has an axial thickness that is greater than the axial thickness of the radially outer annular portion 48.

Radially outer annular portion 48 is configured for ready fastening to the annular mounting flange 32. An annular groove 50 is formed between the radially inner and radially outer annular portions 44, 48 of connector flange 42. Annular groove 50 is dimensioned to intimately receive or otherwise accommodate the dimensionally controlled cylindrical neck portion 30 of the plastic liner 18, as best seen in FIG. 6.

The radially outer annular portion 48 of connector flange 42 has a lower planar sealing surface 48*a*. Circumferentially spaced apart bolt holes 52 extend entirely through the radially outer annular portion 48. Bolt holes 52 correspond to the circumferentially spaced apart bolt holes 40 formed in the upper planar sealing surface 32*a* of annular mounting flange 32. These bolt holes 52 are preferably counter-sunk and may or may not be at least partially threaded, depending upon the type of bolts used for fastening the connector flange 42 to the mounting flange 32.

As shown in FIG. 6, bolts 45 extend through holes 40, 52 to securely fasten the connector flange 42 to the mounting flange 32. Preferably, a planar sealing gasket 54 is disposed between the upper planar surface 32*a* of the mounting flange 32 and the lower planar surface 48*a* of the radially outer annular portion 48 of connector flange 42 to maintain a watertight seal therebetween. Sealing gasket 54 is preferably formed from a cellular urethane foam material have a thickness of about 1/32" with low durometer and high compressibility, but it can be formed from commonly employed rubberized gasket material with favorable compressibility. Gasket 54 has a hole pattern that corresponds to the locations of the boltholes 40, 52 in flanges 32, 42, respectively As best seen in FIGS. 5 and 6, a radially inner edge of the radially outer annular portion 48 of connector flange 42 is truncated to form an angled surface 56. The angled surface 56 forms a triangular groove with the neck portion 30 of liner 18 that accommodates an elastomeric O-ring seal 58, preferably formed from EPDM or a similar material. Seal 58 is positioned about the outer periphery of the cylindrical neck portion 30 of plastic liner 18, and is advantageously compressed when bolts 45 are tightened. This seal 58 between the outer periphery of the neck portion 30 and the connector flange 42 prevents liquid inside the plastic liner 18 from contacting the metallic structural components of pressure vessel 10, including the mounting flange 32 and upper dome 12. The preferential interference fit that exists between the outer diameter of the radially inner annular portion 44 of connector flange 42 and the inner diameter of the neck portion 30 of plastic liner 18, helps to maintain the controlled tolerances which ensure that seal 58 is properly compressed to form a watertight barrier.

The unique construction of connector flange 42 and the complementary way in which it mates with the neck portion 30 of the plastic liner 18 allows the plastic liner 18 and the external tank formed by domes 12, 14 to move independently. Accordingly, dimensional part tolerances and pressure variations experienced during service will not have an adverse effect on the integrity of the seal when bolts 45 are loaded.

It is envisioned and well within the scope of the subject disclosure that the metal band and insulating material described herein can be employed in the fabrication of three-piece pressure vessels. Such pressure vessels include a central cylindrical section bounded by upper and lower domes, so that two distinct weld zones are defined. In such an instance, a metal band and insulating material can be employed in each weld zone to protect a plastic liner enclosed within the three-piece pressure vessel.

Although the pressure vessel of the subject invention has been described with respect to a preferred embodiment, those skilled in the art will readily appreciate that changes and modifications may be made thereto without departing from the spirit and scope of the subject invention as defined by the appended claims.

What is claimed is:

1. A pressure vessel comprising:

a) a lower metallic dome having a lower rim portion;

b) an upper metallic dome having an upper rim portion, wherein the upper metallic dome includes a central orifice;

c) a plastic liner disposed within the upper and lower metallic domes, wherein the plastic liner includes a cylindrical neck portion that extends through the central orifice in the upper metallic dome;

d) an annular mounting flange secured to the upper metallic dome and dimensioned to surround the cylindrical neck portion of the plastic liner, the annular mounting flange having an upper planar surface and a plurality of circumferentially spaced apart bolt holes formed therein;

e) an annular connector flange having a radially inner annular portion defining a central bore for communicating with the central orifice in the upper metallic dome and a radially outer annular portion for fastening to the annular mounting flange, wherein an annular groove is formed between the radially inner and radially outer annular portions of the annular connector flange for accommodating the cylindrical neck portion of the plastic liner;

f) a metallic band disposed between the plastic liner and the upper and lower metallic domes proximate the respective rim portions thereof; and g) an insulating material disposed between the metallic band and the plastic liner, the metallic band and insulating material protecting the plastic liner from elevated temperatures when the upper and lower rim portions of the metallic domes are welded together.

2. A pressure vessel as recited in claim 1, wherein the plastic liner has a circumferential recess for accommodating the insulating material and the metallic band.

3. A pressure vessel as recited in claim 1, wherein the insulating material comprises fiber insulation.

4. A pressure vessel as recited in claim 1, wherein the upper rim portion of the upper metallic dome forms a circumferential flange that surrounds the lower rim portion of the lower metallic dome.

5. A pressure vessel as recited in claim 1, wherein the upper metallic dome includes a central orifice and the plastic liner includes a cylindrical neck portion that extends through the central orifice in the upper metallic dome.

6. A pressure vessel as recited in claim 1, wherein the radially inner annular portion of the connector flange has an axial thickness that is greater than an axial thickness of the radially outer annular portion of the connector flange.

7. A pressure vessel as recited in claim 6, wherein the radially outer annular portion of the connector flange has a lower planar surface and a plurality of circumferentially spaced apart bolt holes are formed therein which correspond to the plurality of circumferentially spaced apart bolt holes formed in the upper planar surface of the annular mounting flange.

8. A pressure vessel as recited in claim 7, further comprising a planar sealing gasket disposed between the upper planar surface of the mounting flange and the lower planar surface of the radially outer annular portion of the connector flange.

9. A pressure vessel as recited in claim 1, wherein a radially inner edge of the radially outer annular portion of the connector flange is truncated to accommodate an O-ring seal positioned about the periphery of the cylindrical neck portion of the plastic liner.

10. A pressure vessel comprising:

a) an upper metallic dome having a central orifice formed therein and an upper rim portion;

b) a lower metallic dome having a lower rim portion secured to the upper rim portion of the upper metallic dome;

c) a plastic liner disposed within the upper and lower metallic domes and including a cylindrical neck portion dimensioned and configured to extend through the central orifice of the upper metallic dome;

d) a mounting flange secured to the upper metallic dome and surrounding the cylindrical neck portion of the plastic liner; and e) an annular connector flange having a radially inner annular portion defining a central bore for communicating with the central orifice of the upper metallic dome, a radially outer annular portion for fastening to the annular mounting flange, and an annular groove formed between the radially inner and radially outer annular portions of the connector flange for receiving the cylindrical neck portion of the plastic liner.

11. A pressure vessel as recited in claim 10, wherein the annular mounting flange has an upper planar surface and a plurality of circumferentially spaced apart bolt holes are formed therein.

12. A pressure vessel as recited in claim 10, wherein the radially inner annular portion of the connector flange has an axial thickness that is greater than an axial thickness of the radially outer annular portion of the connector flange.

13. A pressure vessel as recited in claim 11, wherein the radially outer annular portion of the connector flange has a lower planar surface and a plurality of circumferentially spaced apart bolt holes are formed therein corresponding to the plurality of circumferentially spaced apart bolt holes formed in the upper annular surface of the mounting flange.

14. A pressure vessel as recited in claim 13, further comprising a planar sealing gasket disposed between the upper planar surface of the mounting flange and the lower planar surface of the radially outer annular portion of the connector flange.

15. A pressure vessel as recited in claim 11, wherein a radially inner edge of the radially outer annular portion of the connector flange is truncated to accommodate an O-ring seal positioned about the periphery of the cylindrical neck portion of the plastic liner.

16. A pressure vessel as recited in claim 10, further comprising a metallic band disposed between the plastic liner and the upper and lower metallic domes proximate the respective rim portions thereof.

17. A pressure vessel as recited in claim 16, further comprising an insulating material disposed between the metallic band and the plastic liner, the metallic band and insulating material protecting the plastic liner from elevated temperatures when the upper and lower rim portions of the metallic domes are secured together by welding.

18. A pressure vessel as recited in claim 17, wherein the plastic liner has a circumferential recess for accommodating the insulating material and the metallic band.

19. A pressure vessel as recited in claim 17, wherein the insulating material comprises fiber insulation.

20. A pressure vessel as recited in claim 10, wherein the upper rim portion of the upper metallic dome forms a circumferential flange that surrounds the lower rim portion of the lower metallic dome.

21. A method of fabricating a pressure vessel comprising the steps of:

a) providing a plastic tank liner;

b) circumscribing the tank liner with a layer of insulation;

c) surrounding the insulation with a metallic band;

d) enclosing the tank liner within upper and lower metallic domes;

e) forming a joint between the domes proximate the band; and f) welding the domes to one another at the joint.

22. A method according to claim 21, wherein the step of forming a joint between the domes comprises forming a lap joint between an upper rim portion of the upper metallic dome and a lower rim portion of the lower metallic dome.

23. A method according to claim 21, wherein the step of forming a joint between the domes comprises forming a lap joint with a circumferential flange defined by the upper rim portion of the upper metallic dome surrounding the lower rim portion of the lower metallic dome.

* * * * *